United States Patent [19]

Theimer

[11] Patent Number: 4,906,804

[45] Date of Patent: Mar. 6, 1990

[54] SWITCH FOR A HAIR DRYING DEVICE

[75] Inventor: Hubert Theimer, Nurtingen, Fed. Rep. of Germany

[73] Assignee: ABC-Elektrogeräte Volz GmbH & Co., Kirchheim/Teck, Fed. Rep. of Germany

[21] Appl. No.: 260,814

[22] Filed: Oct. 21, 1988

[30] Foreign Application Priority Data

Oct. 24, 1987 [DE] Fed. Rep. of Germany ..... 3736101

[51] Int. Cl.[4] ..... H01H 25/06; H01H 3/42; A45D 2/36; A45D 4/18

[52] U.S. Cl. ..... 200/52 R; 200/61.85; 200/505

[58] Field of Search ..... 200/573, 52 R, 1 B, 200/61.85, 522, 573, 332, 332.1, 332.2, 505

[56] References Cited

U.S. PATENT DOCUMENTS 4,409,998 10/1983 Bauer ..... 132/9
4,520,256 5/1985 Doyle ..... 200/332.2
4,673,778 6/1987 Lewandowski et al. ..... 200/332
4,820,889 4/1989 Seghetti ..... 200/1 B X

*Primary Examiner*—J. R. Scott
*Attorney, Agent, or Firm*—Marmorek, Guttman & Rubenstein

[57] ABSTRACT

A switch for a hair drying device having a rotatable curling iron and a hair dryer comprises a switching member, first and second microswitches, and a supporting member, preferably including a resilient spring, for the switching member. The supporting member permits the switching member to undergo a planar movement and a tilting movement independently of each other. The planar movement brings the switching member into and out of engagement with the first microswitch, thereby switching the rotation of the curling iron on and off. The tilting movement brings the switching member into and out of engagement with the second microswitch, thereby turning the hair dryer on and off. Thus, the curling iron and the hair dryer are operated independently of each other.

13 Claims, 2 Drawing Sheets

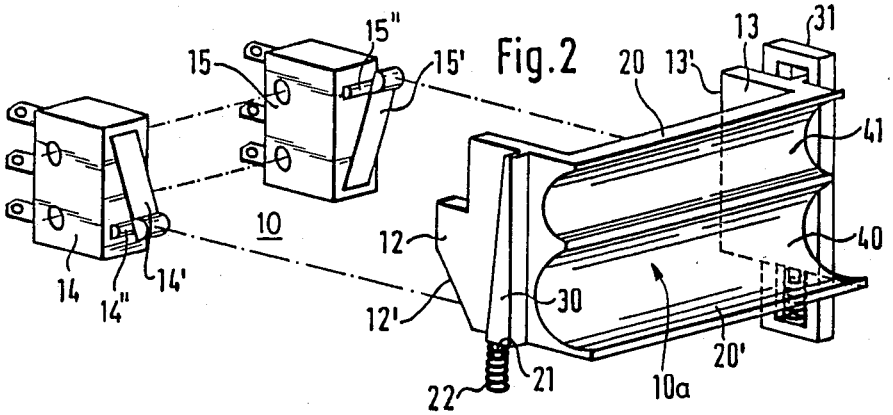
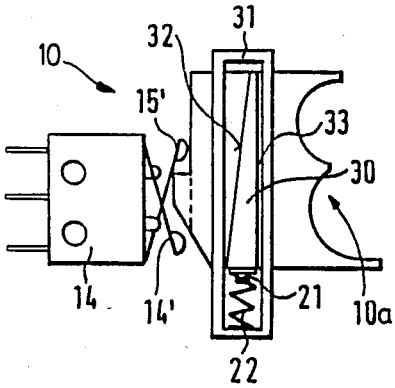
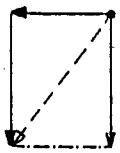
Fig. 3
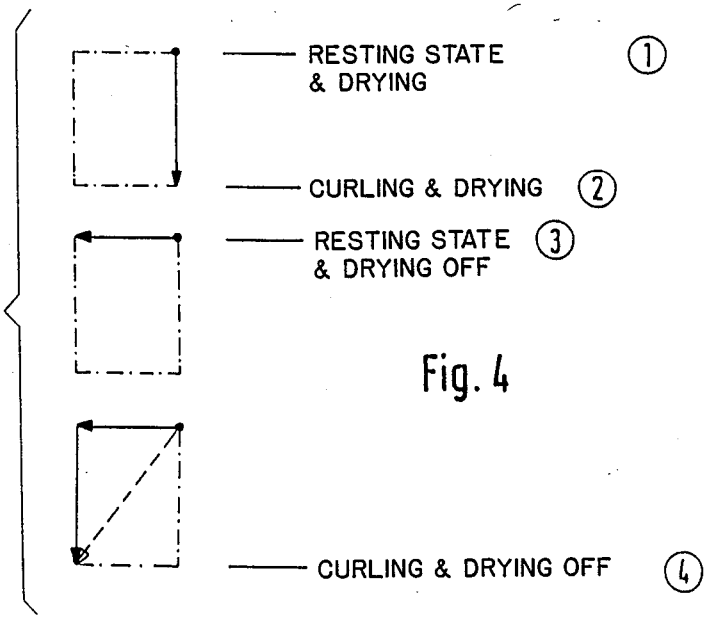
Fig. 4

SWITCH FOR A HAIR DRYING DEVICE

BACKGROUND OF THE INVENTION

The instant invention relates to a switch for a hair drying device which device includes a hair dryer and a rotating curling iron. More particularly, the instant invention relates to a four-position switch which is useful in such a hair drying device.

A hair drying device of the kind described is known from EP Pat. No. 0 052 325.

Basing itself on same, it is the object of the instant invention to design a switch so that the following four functions become possible.

curling iron at rest, hair dryer on;
curling iron in operation, hair dryer on;
curling iron at rest, hair dryer off;
curling iron in operation, hair dryer off.

The possibility of switching the hair dryer and the rotating curling iron on and off independently of each other is to be created. This leads to the four combination possibilities mentioned above. In that case, it is in particular possible to keep the curling iron running without switching on the hair dryer, that is to say without drying action and therefore without heating, for instance in order to treat the hair without drying, merely to smooth it and/or to give it shape. This may be desirable for instance to cool the hair since in the known device the air is in any case sucked through the openings in the curling iron and through the hair wound up on it.

SUMMARY OF THE INVENTION

According to the invention this object is achieved in a switch for a hair drying device having a rotatable curling iron and a hair dryer. The switch comprises a switching member, first and second microswitches, and a supporting member, preferably including a resilient spring, for the switching member. The supporting member permits the switching member to undergo a planar movement and a tilting movement independently of each other. The planar movement brings the switching member into and out of contact with the first microswitch, thereby switching the rotation of the curling iron on and off. The tilting movement brings the switching member into and out of contact with the second microswitch, thereby turning the hair dryer on and off. Thus, the curling iron and the hair dryer are operated independently of each other.

BRIEF DESCRIPTION OF THE DRAWINGS

An embodiment of the invention and of its advantageous aspects are described through the drawings in which:

FIG. 2 is an enlarged perspective view of an embodiment of the inventive switch;

FIG. 3 shows a side view of the inventive switch and of the contacts with which it interacts; and FIG. 4 is a diagram showing the different operating states of the hair drying device.

DETAILED DESCRIPTION OF PREFERRED EMBODIMENT

Figure 1:
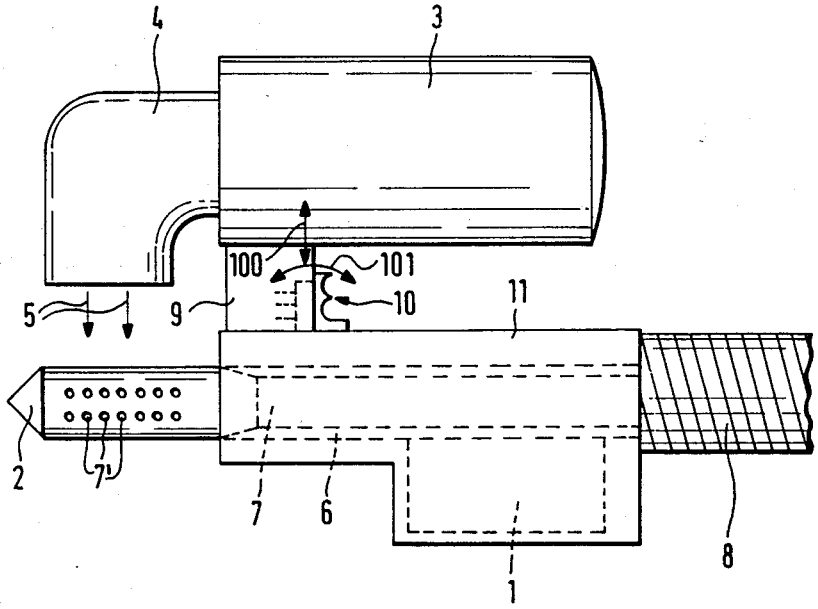
FIG. 1 shows a hair drying device in which a switch according to the invention is utilized.

The known hair drying device comprises a motor 1 located in a handle 11 which drives a hollow sleeve 6 which in turn holds a hollow curling iron 2 provided with openings 7'. A suction channel 7 runs through the sleeve 6 and the curling iron 2. The handle 11 is connected to a negative-pressure source (not shown) via a hose 8. The housing 9 is an integral part of the handle 11. It holds the hair dryer 3 having an outflow nozzle 4. The outflow of hot air from nozzle 4 is in the direction shown by the arrows 5.

According to the invention, the switch 10 includes a hand operable switching member **10*a* is designed so as to be able to carry out the four functions mentioned above. To this end, it can be shifted up and down as shown by the double-headed arrow 100 in FIG. 1. It can furthermore be tilted back and forth as shown by the double-headed arrow 101 in FIG. 1**.

The construction of switch 10 making this possible is illustrated in FIGS. 2 and 3. As can be seen, the switching member **10*a* is constructed from a small plate 20 at the two sides of which the switching cams 12 and 13 are integrally formed. Switching member 10*a* further includes guiding ridges 30 formed along its sides which travel along a course defined by grooves in the frame 31 installed on the small plate 20. Truncated cones 21 are integrally formed at the bottom of ridges 30 or switching cams 12, 13. Truncated cones 21 are held by the springs 22. The springs 22 support the guiding ridges 30 in a resilient manner. The switching member 10*a* can thus be shifted up and down in the frame 31, whereby the switching member 10*a* is constantly pushed by the springs into its upper switching position and can be actuated on the handle by an operator who pushes down on the lower actuating surface 20' of the switching member. Furthermore the switching member 10*a* consisting of small plate 20 with switching cams 12, 13, guiding ridges 30 and truncated cones 21 within frame 31 can be tilted with its upper end from the starting position shown in FIG. 3, wherein the surface 33 of guiding ridge 30 is in contact with the right inner surface of frame 31, towards the left until the surface 32 of guiding ridge 30 is pushed against the inner surface of frame 31**.

The switching cam 12 is configured as shown in FIG. 2, i.e., it is provided with a surface 12' extending at an angle from the bottom right to the top left. When the switching member **10*a* is depressed, i.e., when a downward movement is executed, the surface 12' causes the switching cam 12 to act upon the contact spring 14' of a first microswitch 14, thus closing contact spring 14' with actuator element 14''. This microswitch is used to switch on the drive motor 1 of the curling iron 2. The second switching cam 13 is also provided with a surface 13' used for switching. This surface 13 however extends parallel to the direction of the up and down displacement of the entire switching member 10*a* in the manner described above; the surface 13' therefore makes contact with the contact spring 15' of the second microswitch 15 only when the switching member 10*a* is tilted in the manner as indicated by direction 101 in FIG. 1 thus bringing contact spring 15' (biased outwardly as shown in FIG. 2) into engagement with actuator element 15''. The closing of the second microswitch 15 by this tilting movement can be translated by the switch into turning the hair dryer 3 off so that the motor 1 continues to run and moist air continues to be sucked through the suction channel 7 and the openings 7' from the hair wound up on the curling iron 2**, however without any simultaneous drying action taking place.

As FIG. 2 shows, the switching member 10*a* is provided with two depressions 40, 41 for the fingers to facilitate handling, so that an operator grasping the handle 11 and activating the switch 10 can place his index finger either into depression 40 or 41, depending on whether he wishes to push the switching member up while tilting it at the same time, or whether he only wishes to tilt it in its upper position.

The three operational states of the hair drying device are indicated schematically in FIG. 4. The upper one of the three figures shows that the downward movement without tilting of the switching member 10*a* merely causes the curling iron to be actuated and begin rotating while the dryer is switched on. In the middle diagram the switching member 10*a* remains in an upper position but is tilted. Thereby, the curling iron is not driven and the hair dryer is switched off. In the state of operation shown in the lowest of the three diagrams of FIG. 4, the hair dryer is switched off but the motor 1 of the curling iron 2 is switched on.

While the invention has been described by reference to specific embodiments, this was for purposes of illustration only and should not be construed to limit the spirit or the scope of the invention.

I claim:

1. A switch for a hair dryer device having a rotatable curling member and a hair dryer, said switch comprising a hand operable switching member, first and second electrical microswitches, said first electrical microswitch comprising first and second actuator elements, said second electrical microswitch comprising third and fourth actuator elements, and support means for supporting said switching member for movement in a plane and for tilting movement about an axis in said plane, said planar movement bringing said switching member into and out of contact with said first electrical microswitch to bring said first and second actuator elements into engagement with each other thereby actuating rotation of said curling member, said tilting movement bringing said switching member into and out of contact with said second electrical microswitch to bring said third and fourth actuator elements into engagement with each other thereby actuating said hair dryer, said planar and tilting movements being independent of each other whereby rotation of said curling member and actuation of said hair dryer occur independently of each other.

2. The switch of claim 1 wherein said plane is a vertical plane.

3. The switch of claim 1 wherein said hair dryer is switched off when said switching member is brought into contact with said second microswitch and said hair dryer is switched on when said switching member is brought out of contact with said second microswitch member.

4. The switch of claim 1 further comprising first and second cam members on said switching member, said first cam member being brought into and out of contact with said first microswitch, said second cam member being brought into and out of contact with said second microswitch.

5. The switch of claim 4 wherein said first cam member includes a camming surface which is oblique to said plane, said camming surface being brought into and out of contact with said first microswitch when said switching member is moved in said plane.

6. The switch of claim 4 wherein said second cam member includes a camming surface parallel to said plane, said camming surface being brought into and out of contact with said second microswitch when said switching member is tilted out of said plane.

7. The switch of claim 4 wherein said switching member comprises a plate having sides, said first and second cam members being integrally formed adjacent to said sides of said plate.

8. The switch of claim 7 further comprising truncated cones located at an underside of said plate, each of said truncated cones being received within said support means, said support means further comprising at least one spring which is resilient along said plane and out of said plane.

9. The switch of claim 1 further comprising a guiding ridge located on opposite sides of said switching member, said switch further comprising a frame with a groove associated with each guiding ridge, said groove being parallel to said plane, said guiding ridge travelling within said groove.

10. The switch of claim 9 wherein said guiding ridge is of triangular cross-section, said narrow portion of said guiding ridge permitting limited tilting movement of said guiding ridge in said groove.

11. The switch of claim 1 wherein said switching member includes finger receiving depressions

12. The switch of claim 7 further comprising truncated cones located at an underside of said cam members, each of said truncated cones being received within said support means, said support means comprising at least one spring which is resilient along said plane and out of said plane.

13. A four position electric switch for switching two functions on and off independently of each other, comprising a hand operable switching member, first and second electric microswitches, said first electrical microswitch comprising first and second actuator elements, said second electrical microswitch comprising third and fourth actuator elements, and support means for supporting said switching member for movement in a plane and for tilting movement, said planar movement bringing said switching member into and out of contact with said first electric microswitch to bring said first and second actuator elements into engagement with each other thereby switching said first electrical microswitch on and off, said tilting movement bring said switching member into and out of contact with said second electrical microswitch to bring said third and fourth actuator elements into engagement with each other thereby switching said second electrical microswitch on and off, said planar and tilting movements of said switching member being independent of each other.

* * * * *